United States Patent [19]

Kolacz

[11] Patent Number: 4,483,278

[45] Date of Patent: Nov. 20, 1984

[54] FULL VIEW ENGINE COVER

[76] Inventor: Stephen J. Kolacz, 4047 Meadow Way., Marietta, Ga. 30066

[21] Appl. No.: 493,210

[22] Filed: May 10, 1983

[51] Int. Cl.[3] ..... F02B 75/34; F02F 1/00

[52] U.S. Cl. ..... 123/41.33; 123/DIG. 3; 123/196 AB; 123/198 E; 123/195 C; 434/389

[58] Field of Search ..... 123/DIG. 3, 196 AB, 123/41.33, 198 E, 1 R, 195 C; 434/389

[56] References Cited

U.S. PATENT DOCUMENTS

Re. 30,253 4/1980 Haldeman et al. ..... 123/DIG. 3

FOREIGN PATENT DOCUMENTS 54-134234 10/1979 Japan ..... 123/196 AB 502396 3/1939 United Kingdom ..... 123/196 AB

*Primary Examiner*—Ira S. Lazarus

*Attorney, Agent, or Firm*—Sherman & Shalloway

[57] ABSTRACT

An engine cover is disclosed which replaces the conventional cover generally found on small internal combustion engines. The cover is preferably made of clear Lexan TM plastic and is designed to withstand the forces and heat generated by normal engine operation. The cover preferably includes as an integral part thereof a main bearing with heat sinking an auxiliary bearing and an oil fill port.

15 Claims, 5 Drawing Figures

Fig. 3
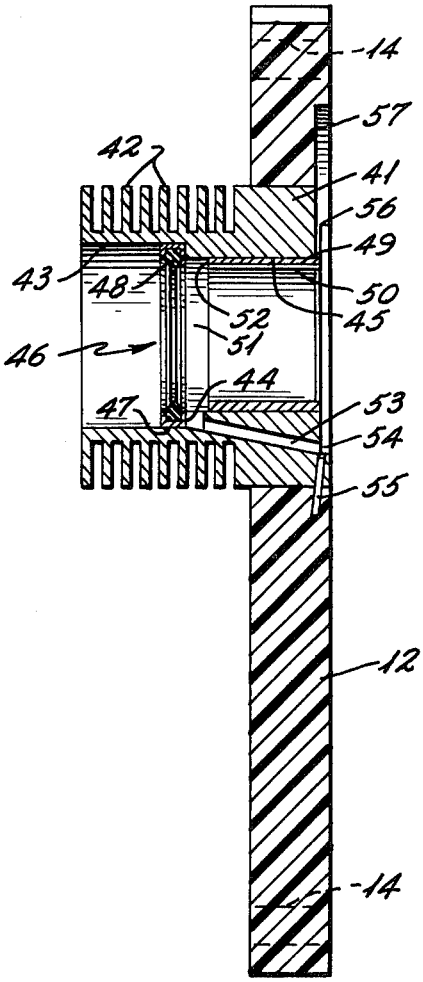
Fig. 4
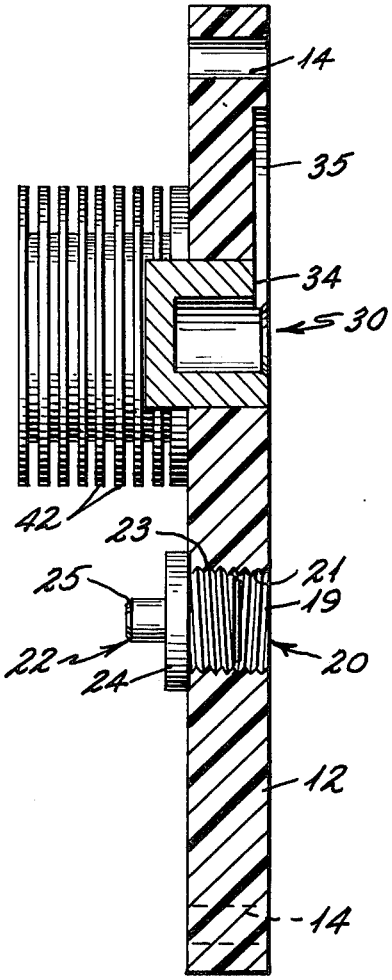
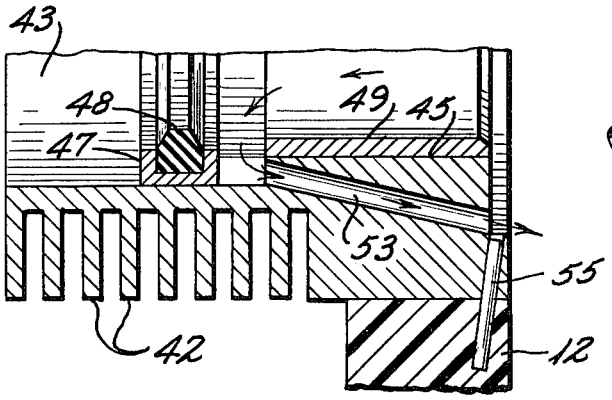
Fig. 5

FULL VIEW ENGINE COVER

BACKGROUND OF THE INVENTION

This invention relates to a replacement cover for a small internal combustion engine. While such a cover could be incorporated into a new engine, at present, engines are manufactured with non-transparent covers.

In the past, transparent engine covers have been used. The following prior art is known to applicant in this regard:

(1) U.S. Pat. No. D 244,760 to Phillips discloses a design for a model of a rotary Wankel engine which includes a transparent cover and a crank to rotate the engine.

(2) U.S. Pat. No. 2,269,035 to Neal shows a transparent window 9 for allowing viewing of the internal components of an internal combustion engine.

The main drawback of these prior art designs as concerns the instant invention is the fact that neither of them is intended to be installed in an engine other than for purposes of display. Phillips discloses a model of an engine which only rotates through a crank, not through combustion. Neal specifically discloses the following:

"Since the engine is for purely demonstrative or educational use, to show or disclose the operations of such machines, and not for normal power delivery or turning out appreciable work, it can be made very small and of very light weight."

With regard to another aspect of the instant invention, namely, the concept of a main crankshaft bearing with heat sinking structure, the following prior art is known to applicant:

(1) U.S. Pat. No. 1,108,761 to Kieser discloses a shaft bearing in a bearng box with fins.

(2) U.S. Pat. No. 2,220,061 to Dempsey discloses sheet metal disks forming fins for heat radiation.

(3) U.S. Pat. No. 2,352,206 to Kendall shows a bearing wherein the outer race support member includes cooling fins.

(4) U.S. Pat. No. 2,866,669 to Brennan discloses the use of aluminum fins in alternating relation with carbon bearings.

(5) U.S. Pat. No. 3,959,677 to Grieb discloses a heat sink in conjunction with a plastic motor housing subject to thermal distortion. A heat sink provides a surface for the motor shaft bearing.

Applicant also wishes to bring to the attention of the U.S. Patent and Trademark Office a remotely related device manufactured by Divnick International, Inc. of Berrien Springs, Mich. and marketed under the trademark "View-Eze." This device was conceived after the initial conception of applicant's invention and includes a clear plastic cover with main and auxiliary needle bearings and a fill port. This device includes none of the heat sinking, bearing sealing or lubricant accessing structure of applicant's invention and in view of its date of conception is not prior art. Incidentally, the "View-Eze" cover was only produced for a short period of time because its design was found to be unworkable since excessive heat build-up due to lack of bearing lubrication and heat sinking caused destruction of the cover under normal engine operating conditions.

SUMMARY OF THE INVENTION

The instant invention overcomes the drawbacks of the above noted prior art inventions by incorporating the following features:

(1) The main structural element comprises a strong plastic cover, preferably, of Lexan plastic, configured with the same dimensions as the metal cover which it is intended to replace;

(2) Integrally incorporated therewith is a main crankshaft bearing assembly. This assembly includes a number of components, namely, a bearing housing fixedly attached to the cover, a bearing member and a seal member. The bearing housing includes integral heat dissipating fins.

(3) Also integrally incorporated therewith is an additional cap-like bearing which accommodates the shaft end of a gear assembly located in the engine.

(4) Further, the cover includes an oil fill port which includes a threaded port located on the cover and a complimentarily threaded cap which sealingly closes the port.

Accordingly, it is a first object of the instant invention to provide an engine cover of a transparent material to enable viewing of the internal workings of such engine.

It is a further object of this invention to provide a transparent engine cover usable with a fully operative engine and designed to withstand the forces and temperatures generated during full output thereof.

It is a still further object of the invention to provide an engine cover incorporating main and auxiliary bearings, as well as an oil fill port.

These and other objects, features and advantages of the invention will be readily apparent from the following description of the preferred embodiment thereof taken in conjunction with the accompanying drawings.

BRIEF DESCRIPTION OF THE DRAWINGS

FIG. 3 is a sectional view along the line 3—3 of FIG. 2.

FIG. 4 is a sectional view along the line 4—4 of FIG. 2.

FIG. 5 is an enlarged view of a portion of the bearing assembly as best shown in FIG. 3.

DESCRIPTION OF THE PREFERRED EMBODIMENT

Figure 1:
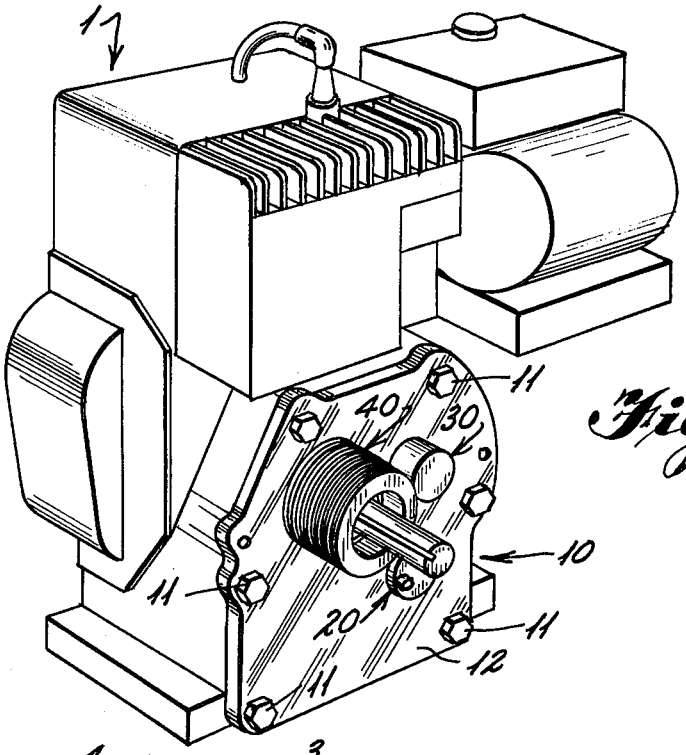
FIG. 1 shows a perspective view of the cover mounted on an internal combustion engine.

Referring to FIG. 1, an example of an internal combustion engine 1 is shown. In this example, the engine is a Briggs and Stratton four stroke 2 horsepower engine used mainly in applications such as, for example, as the powerplant for a gasoline engine powered lawnmower. Reference numeral 10 is used to identify the inventive cover which is secured to the engine with bolts 11 extending through holes 14 in plate 12. The cover includes oil fill port 20, auxiliary bearing 30 and main bearing 40, all of which are integrally attached to the cover plate 12.

Figure 2:
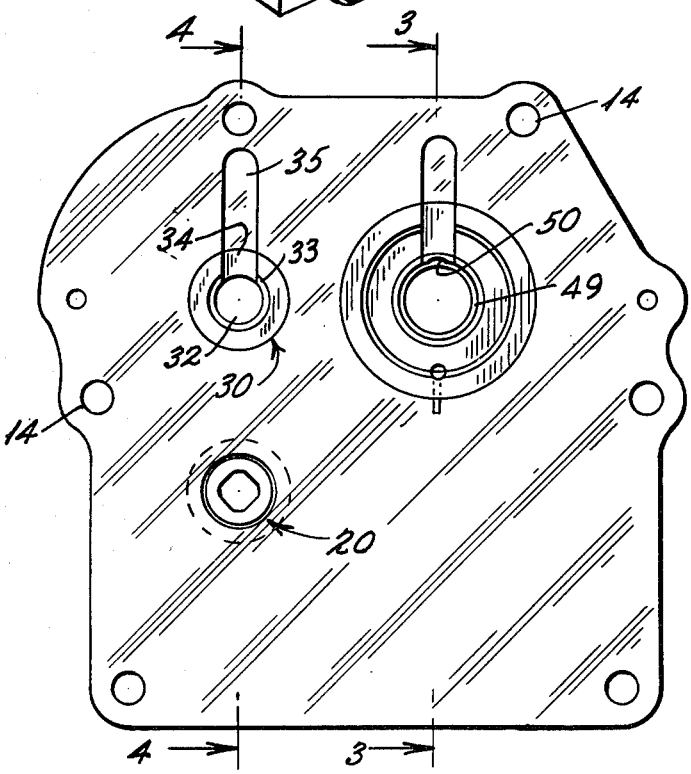
FIG. 2 shows a view of the cover from the side thereof adapted to face the inside of the engine.

Referring now to FIGS. 2 and 4, the oil fill port 20 and auxiliary bearing 30 will be described. As shown, the oil fill port 20 comprises opening 19 with threads 21 in cover plate 12 and cap 22 with complimentary threads 23, flat portion 24 bearing against plate 12 and gripping means 25 which may be grasped to thereby rotate and remove or replace the cap 22. If desired, threads 21 may instead be formed on an element (not shown) embedded in plate 12. Flat portion 24 acts as a seal to prevent oil leakage.

Auxiliary bearing 30 includes a bearing member 31. Bearing member 31 includes a cylindrical recess 32 with a chamfered opening 33, which recess receives the shaft (not shown) of an engine gear which is part of the gear train (not shown) which turns main shaft 13. The bearing member 31 also includes a notch 34 which is continued on plate 12 by groove 35. In operation, the above noted engine gear rotates in close relation to the cover plate 12. The centrifugal forces thereby created would normally prevent oil from entering the recess to lubricate and cool the shaft and bearing 30. The provision of notch 34 and groove 35 provides sufficient spacing between the engine gear and the cover plate 12 to allow oil to enter the bearing recess 32 unaffected by the gear centrifugal forces to lubricate and cool the shaft and bearing 30. If desired, bearing 30 may include heat dissipating fins or other heat exchange structure as an integral part thereof.

Referring now to FIGS. 3 and 5, the main bearing 40 includes bearing housing 41. The bearing housing 41 includes a plurality of heat dissipating fins 42 as well as a stepped bore 43, 45 stepped at shoulder 44. In the preferred embodiment, fins 42 are located in generally surrounding relation to bore 43 and also surround a portion of bore 45. Within the bore 43 is placed a seal assembly 46 which is comprised of rigid housing 47 and seal 48. The outer diameter of housing 47 is sized so as to enable press fitting thereof into bore 43. In assembly the seal assembly 46 rests against shoulder 44. A bearing 49 is preferably glass or other transparent material. Housing 41 is preferably made of aluminum as is bearing 30. Cap 22 may be made of any plastic or metal while seal assembly 46 is preferably made with housing 47 of metal and seal 48 of rubber or plastic. Bearing 49 may be made of any suitable bearing material and pin 55 is preferably metal.

The fins 42 increase the surface area of housing 41 and thereby increase the heat exchange capabilities thereof. Since the preferred material for plate 12 does not appreciably radiate or conduct heat, the housing 41 becomes the main source of heat dissipation for the cover 10. The fins 42 are carefully designed to include sufficient surface area so as to substantially duplicate or exceed the surface area of the metal engine cover which the instant invention replaces. Thus, the heat dissipation designed into the engine is maintained or exceeded.

With the inventive cover installed on the engine as shown in FIG. 1, the engine may be operated in one of two modes:

(1) The invention may be operated normally with oil in the crankcase. In this mode, splashing oil may slightly hamper visibility but oil level may easily be monitored. If desired, graduations (not shown) may be marked on the cover representative of the oil level.

(2) The oil may be drained from the engine which is then treated with a product such as Petrolon Slick 50, a TFE engine metal treatment. In this mode, the engine may be run normally and moving parts are as such easily visible.

The most important aspect of the instant invention is the fact that it allows normal loaded operation of an internal combustion engine.

Although the invention has been described with reference to a preferred embodiment, various changes and modifications may be made without departing from the fully intended scope thereof as defined by the following claims.

I claim:

1. A transparent cover for an engine comprising:

(a) first means comprising a plate means dimensioned to cover an opening in said engine;

(b) second means removably attaching said plate means to said engine;

(c) said plate means being made of a heat resistant material whereby said engine may be operated in a normal fashion without damaging said cover;

(d) main bearing means rigidly mounted on said plate means, said main bearing means being located on said plate means so as to support in bearing relation a drive shaft of said engine, and (e) said main bearing means including a bearing housing in which is mounted a main bearing, said bearing housing including heat dissipating fin means as an integral part thereof.

2. The invention of claim 1 wherein said plate means is made of plastic.

3. The invention of claim 2 wherein said plate means is made of a polycarbonate thermoplastic.

4. The invention of claim 1 wherein said plate means is made of glass.

5. The invention of claim 1, wherein said second means comprise a plurality of threaded bolts extending through holes in said plate means and threaded holes in said engine.

6. The invention of claim 1 wherein a seal is mounted in said bearing housing which sealingly engages said drive shaft.

7. The invention of claim 6 wherein said main bearing includes a first notch located in an inner periphery thereof, said notch allowing oil from a crankcase of said engine to traverse said main bearing.

8. The invention of claim 7 wherein an annular chamber is formed in said bearing housing by said drive shaft, said main bearing and said seal, and a drain passage is formed in said bearing housing allowing oil entering said chamber through said first notch to drain back to said crankcase.

9. The invention of claim 7 wherein a second notch is formed by said bearing housing and said plate means, said second notch providing sufficient spacing between said plate means and a gear mounted on said drive shaft to alleviate centrifugal forces caused by spinning of said gear and thereby allowing oil to enter said first notch to lubricate and cool said main bearing and said drive shaft.

10. The invention of any one of claims 1, 6 or 8 wherein an auxiliary bearing means is rigidly mounted on said plate means, said auxiliary bearing means being located on said plate means so as to support in bearing relation a gear shaft of said engine.

11. The invention of claim 10, further comprising an oil fill port integrally formed on said plate means, and cap means removably and sealingly closing said oil fill port.

12. The invention of claim 1 wherein said plate means is substantially flat.

13. A transparent cover for an engine comprising:

(a) plate means dimensioned to cover an opening in said engine;

(b) main bearing means mounted on said plate means for supporting in bearing relation a drive shaft of said engine;

(c) auxiliary bearing means mounted on said plate means for supporting in bearing relation a gear shaft of said engine;

(d) oil fill port means formed on said plate means and removably sealed by cap means;

(e) said plate means being made of a heat resistant material whereby said engine may be operated normally without damage to said transparent cover;

(f) one of said main bearing means and said auxiliary bearing means including a housing with integrally mounted heat dissipating fin means for dissipating heat generated by said engine.

14. The invention of claim 13 wherein said plate means is made of a polycarbonate thermoplastic.

15. A transparent cover for an engine comprising:

(a) first means comprising a plate means dimensioned to cover an opening in said engine;

(b) second means removably attaching said plate means to said engine;

(c) said plate means being made of a heat resistant material whereby said engine may be operated in a normal fashion without damaging said cover;

(d) said plate means having bearing means mounted thereon;

(e) said engine including shaft means rotated thereby which shaft means is adapted to extend into said bearing means;

(f) said shaft means including means rotated thereby, said rotated means being located on said shaft means adjacent said bearing means; and (g) notch means formed by said plate means and said bearing means, said notch means providing sufficient spacing between said plate means and said rotated means to alleviate centrifugal forces caused by spinning of said rotated means and thereby allowing oil to enter said notch means and thence to enter said bearing means to lubricate and cool said bearing means.

* * * * *